United States Patent [19]

McGraw et al.

[11] Patent Number: 4,814,050

[45] Date of Patent: Mar. 21, 1989

[54] ESTIMATION AND CONTROL OF ALUMINA CONCENTRATION IN HALL CELLS

[75] Inventors: William D. McGraw, Monroeville, Pa.; Kevin G. Christian, Brookline, Mass.; William M. Hall, Lower Burrell, Pa.; Gene S. Miller, Maryville, Tenn.; Christopher M. Seaman, Troy, N.Y.; Robert L. Kozarek, Apollo, Pa.

[73] Assignee: Aluminum Company of America, Pittsburgh, Pa.

[21] Appl. No.: 122,190

[22] Filed: Nov. 18, 1987

Related U.S. Application Data

[63] Continuation-in-part of Ser. No. 915,666, Oct. 6, 1986, abandoned.

[51] Int. Cl.[4] ..... C25C 3/06

[52] U.S. Cl. ..... 204/67; 204/245

[58] Field of Search ..... 204/67, 243 R, 245

[56] References Cited

U.S. PATENT DOCUMENTS

| | | | |
|---|---|---|---|
| 3,622,475 | 11/1971 | Shiver | 204/67 |
| 3,625,842 | 12/1971 | Bristol | 204/67 |
| 4,488,117 | 12/1984 | Seo | 324/425 |

OTHER PUBLICATIONS

"A Multi-Variable Control in Aluminum Reduction Cells", Erik Gran, 1980, Modeline, Identification and Control (vol. 1, No. 4, pp. 247–258).

"Adaptive Control of Aluminum Reduction Cells with Point feeders", T. Moen, J. Aalbu, and T. Boy.

"Estimation of States in Aluminum Reduction Cells Applying Extended Kalman Filtering Algouthm Together with a Nonlinear Dynamic Model and Direct Measurements", K. Vee and E. Gran.

*Primary Examiner*—John F. Niebling
*Assistant Examiner*—Ben C. Hsing
*Attorney, Agent, or Firm*—Elroy Strickland

[57] ABSTRACT

A method of estimating and controlling the concentration of alumina in the bath of a Hall cell. The method includes the use of an estimator that employs two sets of equations, namely, a time update algorithm that contains a dynamic model of the alumina mass balance of the cell and provides estimates of alumina concentration, and a measurement algorithm that uses a process feedback variable from the cell to modify the alumina estimate. In addition, the method includes the use of one or more tuning parameters, such as state noise variance and measurement noise variance. The measurement noise variance is modified by the process noise variance in a manner that increases measurement noise variance for high values of process noise and decreases measurement noise variance for low values of process noise. In addition, one or more of the parameters of the model are modified by the feed history of the cell.

6 Claims, 2 Drawing Sheets

ESTIMATION AND CONTROL OF ALUMINA CONCENTRATION IN HALL CELLS

BACKGROUND OF THE INVENTION

Figure 1:
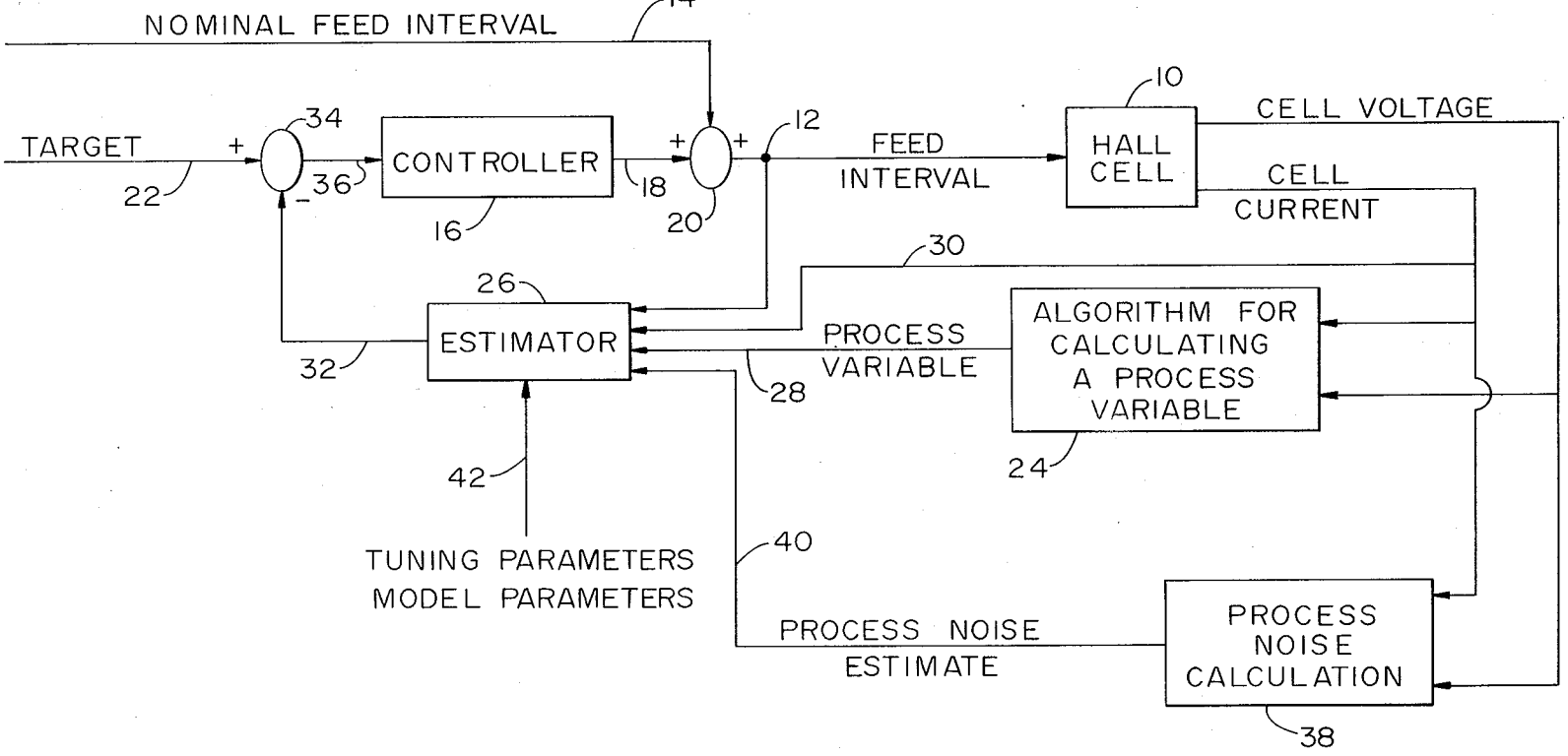

This application is a continuation-in-part of U.S. patent application U.S. Ser. No. 915,666 filed October 6, 1986, now abandoned.

The present invention relates generally to the control of Hall cells for the production of aluminum, and particularly to the use of an estimation algorithm that provides the best available estimate of alumina concentration in the electrolytic bath of a Hall cell and control of alumina concentration.

The Hall cell process involves electrolysis of alumina into aluminum metal such that the alumina is consumed in direct proportion to the amount of metal produced. The concentration of alumina in the electrolyte of the cell is thereby reduced, and a point is often reached where a phenomenon known as an "anode effect" occurs. When this occurs, the voltage drop across the cell rapidly rises to a substantial value. The anode effect is typically terminated by the addition of more alumina and moving the anode bridge.

Anode effects are a disadvantage because a large amount of power is consumed without a substantial productive effort. In addition, overheating of the electrolyte can occur, with the resultant loss of bath components by volatilization. And, because Hall cells are connected together in electrical series in large groups (pot lines) any major upset condition in one cell affects the other cells in the series.

Anode effects, however, are less serious than severe overfeeding of alumina to the cell. With such overfeeding, alumina does not dissolve in the electrolyte and, therefore, tends to settle out at the bottom of the cell, seriously disrupting the distribution of current in the cell, and reducing current efficiency and metal production. And, while it may take relatively short period of time to terminate an anode effect, a "sick cell" (from overfeeding) takes a considerably longer time to return to normal operation. Thus, it is the usual practice to operate in the lower part of the alumina concentration range and, therefore, cause a certain frequency of anode effects, to specifically prevent overfeeding and the resultant sick cell condition.

A feed control scheme that has been common in the industry has been to periodically calculate the electrical resistance of the cell from measurements of cell voltage and current. When cell resistance increases to some predetermined level, alumina is added to the cell. There are many U.S. patents describing this scenario, two of which are U.S. Pat. Nos. 3,622,475 and 3,625,842 to Shiver et al and Bristol et al, respectively.

Another method for controlling the feed of alumina to a Hall cell employs a mass balance model of the alumina concentration. The model predicts alumina concentration by considering the amount (mass) of alumina added and consumed and takes into consideration the weight of the electrolyte. More particularly when the concentration of alumina decreases to the point that an anode effect occurs, information about the mass balance in the cell is provided.

Combining the mass balance technique and a variable of the reduction process that is related to alumina concentration to control cell operation is discussed in the following papers:

"A Multi-Variable Control in Aluminum Reduction Cells", by Erik Gran, 1980, *Modeling, Identification and Control* (Volume 1, No. 4, pp. 247–258).

"Adaptive Control of Aluminum Reduction Cells with Point Feeders", by T. Moen, J. Aalbu, and T. Borg (publisher and date of publication unknown).

"Estimation of States in Aluminum Reduction Cells Applying Extended Kalman Filtering Algorithm Together with a Nonlinear Dynamic Model and Discrete Measurements", by K. Vee and E. Gran (publisher and date of publication unknown).

The above paper of Moen et al, for example, describes a model of the Hall cell process having two inputs, namely, alumina feed rate and bridge movement. The output of the model is a change in cell resistance from one period of measurement to the next.

The article by Erik Gran describes a mass and energy balance model that uses "state" variables such as cell resistance to control anode adjustment and supply of alumina. The author seeks to control the entire mass-energy balance of Hall cells using a nonlinear multivariable control scheme. Such a scheme is quite complicated and, as recited on page 254 of the article "In this project, much work has been done in getting more information from measuring the resistance. For some pots, it is sometimes possible to predict the anode effect and thereby control the percentage of dissolved alumina. However, generally this is not possible."

The Vee and Gran paper uses similar complicated nonlinear multivariable techniques. They discuss estimation of cell behavior by measuring cell resistance (again) and the mean temperature of cell lining at the sides. The authors conclude that the uncertainties of bath temperature and alumina concentration make it difficult to know the effectiveness of their estimator.

In addition, measurements of electrical resistance as a means to control alumina concentration are unreliable, as cell resistance is also directly dependent upon electrode spacing.

Further Gran and Vee seek to develop a reduced order linear model about a nominal trajectory from a nonlinear model to make use of a Kalman filter. Such an approximation will and must change, as the nominal operating conditions of a cell change.

What is therefore needed in this area and provided by this invention is to focus on the problem of alumina concentration estimation and control. This focus involves the use of a simple, linear, scalar mass balance model that is effective to (1) eliminate the need to develop any approximate models, and (2) is valid over the entire operating range of the cell being controlled.

SUMMARY OF THE INVENTION

The present invention is directed to the estimation and control of alumina concentration in a Hall cell using a simple linear estimation algorithm that concentrates on the primary problem of Hall cell operation, namely, the concentration of alumina in the cell electrolyte. The estimation algorithm has the following features:

(A) it is based on the Kalman filter type algorithm but contains the following significant enhancements:

(1) a time update equation that can run more frequently than a measurement update equation (both defined below) to provide frequent estimates of the alumina concentration;

(2) a state noise variance tuning parameter that is modified by the number of time updates between measurement updates;

(3) an estimate of poocess noise which is used to modify a measurement noise variance tuning parameter;

(4) a method for using a nonlinear and nonfunctional relationship between the feedback variable and alumina concentration in the measurement update equation; and (5) the ability to adaptively update the parameters of the process model based on the feed history of the cell; and, (B) it uses an algorithm (described below) for calculating a feedback variable and a model of the relationship between the feedback variable and alumina concentration. This relationship is employed to convert the feedback variable to units of alumina concentration for use in the measurement equation. This estimation/control algorithm is superior to othe methods used in the industry because (1) the estimator output and control setpoints are in direct terms of alumina concentration; this allows operating personnel to input target control values in such terms to a controller, i.e., no conversions are required of such personnel;

(2) the estimator is able to recognize when the process feedback signal is too noisy or unavailable and continue to provide a reasonable estimate during this condition by automatically placing more emphasis on the process model relative to the feedback measurement;

(3) the estimator has less phase shift for the same amount of smoothness as a first order digital filter with the same cutoff frequency; and (4) the sensitivity of the estimator to errors in model parameters of bath weight, current efficiency and the size of feed shot is smaller than that of the open loop mass balance model by itself.

The time update equation of the estimator contains a dynamic model of the alumina mass balance in the Hall cell. The model is employed to predict the alumina concentration in the bath at the end of a given period of time. The prediction is made by adding to an immediate previous estimate the amount of alumina fed to the cell, minus the amount of alumina consumed in the production of metal during the period of time.

The measurement update equation obtains a feedback estimate of alumina concentration from a feedback variable and compares it to the alumina concentration prediction obtained from the time update equation. Any difference between the two is multiplied by the gain of the estimator and added to the time update prediction to obtain the new, best estimate of alumina concentration at the end of the period. The gain of the estimator is used to shift its emphasis between the process model and the feedback measurement. It is obtained from estimates of the variances of state noise and measurement noise tuning parameters (both defined below). Increases in measurement noise variance shifts the emphasis of the estimator to the model by applying more filtering in the measurement equation.

The feedback variable is calculated from measurements of cell voltage and current. Several different feedback variables can be calculated. One of the variables used in this invention is defined as the value of the voltage that would be obtained by extrapolating the slope of the voltage-ampere curve of the cell (around the operating point of the cell) back to zero current. See FIG. 2 of the drawings. In practice it is calculated by collecting voltage and current data at a fast rate (5 times per second for example) for a period of time (about 3 minutes), and performing a linear regression calculation on the data to determine the voltage value at zero current. The theoretical relationship between this value and alumina concentration is shown by the curve in FIG. 3 of the drawings. This curve is typical for normal cell operating conditions. Curves of this type are acquired for specific cell conditions, and are used to obtain the feedback alumina concentration from a given feedback value.

State noise is the difference occurring between the actual almina concentration and the alumina concentration Predicted by the dynamic model. This difference is usually the result of modeling errors (such as wrong values of (1) current efficiency, (2) the amount of feed fed to the cell during a feed interval, and/or (3) bath weight). State noise is also due to disturbances in the cell processes, such as when the crust that forms over the bath falls into the bath, thereby suddenly adding ore (alumina) to the bath. Measurement noise is the result of the uncertainty of the actual value of the feedback variable. Gain in the present invention is time varying but eventually reaches a steady state value if the state and measurement noise variances remain constant.

THE DRAWINGS

Figure 2:
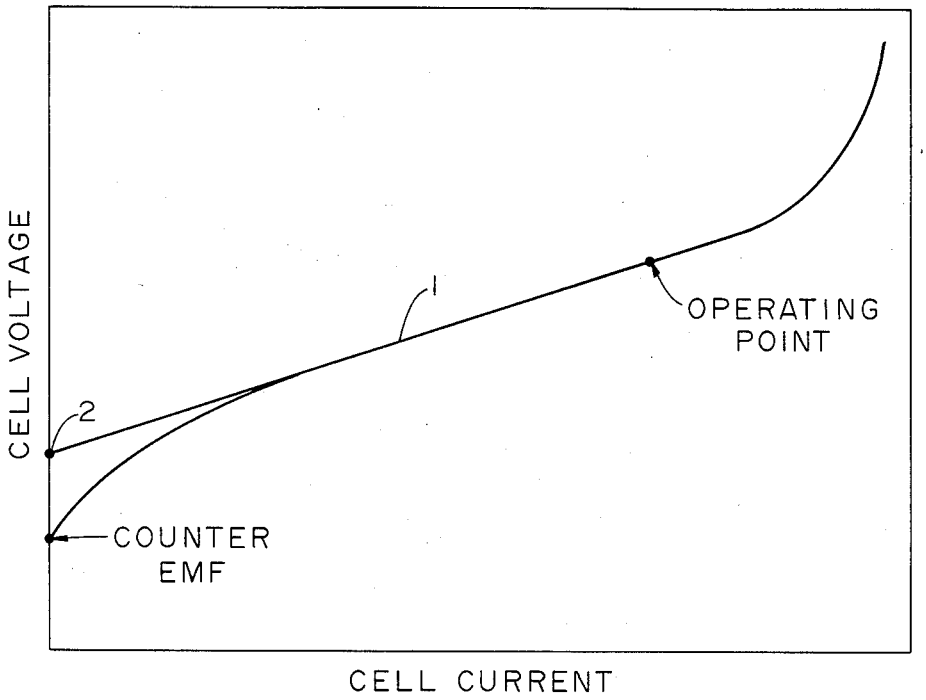
Figure 3:
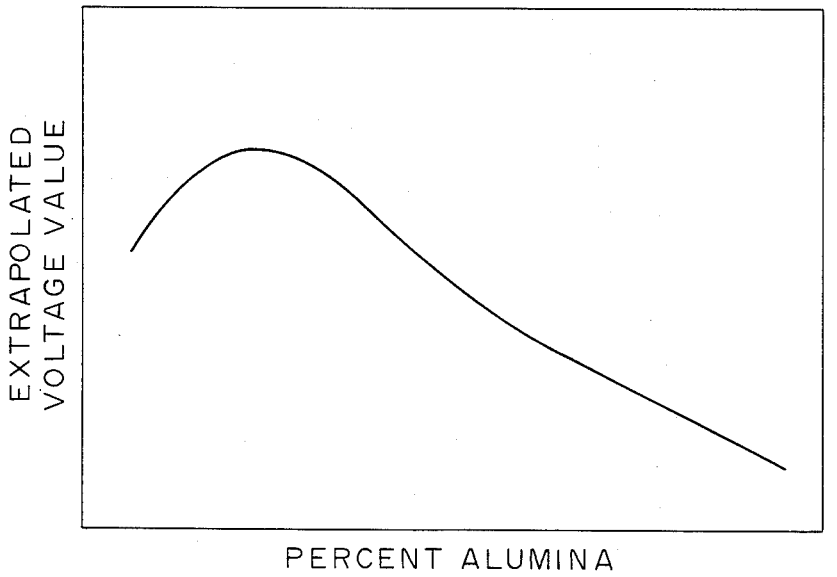

The invention, along with its advantages and objectives, will be best understood by consideration of the following detailed description and the accompanying drawings in which FIG. 1 is diagrammatic representation of the control processes of the invention, FIG. 2 is a graph of a volt-ampere curve an operating Hall cell, and FIG. 3 is a curve showing the theoretical relationship between alumina concentration and a feedback variable obtained from the curve of FIG. 2.

PREFERRED EMBODIMENT OF THE INVENTION

Referring now to FIG. 1 of the drawings, a Hall cell is depicted schematically at 10, which cell, when operating, is fed with alumina at a feed interval, as shown diagrammatically by line 12. Ordinarily, a "nominal" feed interval is one that causes no change in the alumina concentration in cell 10, the nominal feed interval being depicted as line 14 in FIG. 1.

Fixed amounts of alumina are fed to the cell from a fixed volume chamber (not shown) under the control of an electrical control device (controller 16). Controller 16 can be any one of a number of standard devices that sense an error or deviation from a target value for alumina concentration. In FIG. 1, the target value is indicated by line 22. The output of the controller, at 18, is added to the nominal feed rate at junction 20 in accordance with the control method presently to be described.

Electrolytic production of aluminum from alumina in the bath of cell 10 is effected through an appropriate voltage established across the cell and an appropriate amount of line current flowing through the bath such that the cell operates at a certain current value on a volt-ampere curve 1 of the cell. This is shown in FIG. 2, curve 1 having a certain slope, as shown. In FIG. 1, such cell voltage and current are shown directed as inputs to an algorithm 24. This algorithm calculates a counter emf value 2 by extrapolating the slope of the volt-ampere curve of FIG. 2 in a straight line back to a zero ampere value. This is accomplished by use of a linear regression calculation that utilizes, as a block of data, samples of cell voltage and current obtained at a certain minimum rate, e.g., at least one sample being taken every five seconds. The result of this calculation is a process feedback variable 28. Variable 28 is directed to an estimator 26, such as a Kalman filter, for use in obtaining an estimate of alumina concentration in accordance with the relationship shown in FIG. 3. Other variables related to the concentration of alumina in the cell bath can be used as the process feedback variable, such as the resistance measurements of the above referenced articles. However, the value provided by 24 is a preferred variable, as it is not affected by changes in the distance or spacing between the electrodes of the cell. This is not the case with cell resistance.

The block of data upon which the above linear regression is calculated can be obtained as follows: cell voltage and line current are sampled every two hundred milli-seconds. For each two hundred milli-second sample of voltage and current, a resistance is calculated using the formula:

$$R = V - 1.76/I$$

where 1.76 is a nominal counter EMF value.

Next, an outlier check is performed by comparing each resistance value with a digitally filtered resistance value. If the absolute difference between each sample of new resistance and the filtered resistance is greater than a certain limit, the readings of cell voltage and line current are considered an "outlier" and are not used for the extrapolation calculation.

If the sample voltage and current pass the outlier check, the line current is compared to each of say twenty six 1,000 amp line current ranges. A plurality of values are collected in each line current range. If there are eight values, for example in a range, additional values for that range are discarded.

With the sample current values now categorized in terms of current ranges, summations of cell voltages and currents are made and updated by a computer from the data of the samples for a period of time, such as three minutes, as follows:

- Summation of cell voltages
- Summation of cell current
- Summation of cell voltages$^2$
- Summation of cell currents$^2$
- Summation of the products of cell voltages and currents
- Summation of the number of sample pairs (voltage and current) employed in the above summary.

The above summations are employed in the linear regression calculation to estimate counter EMF if there are a minimum of say 8 line current ranges containing 8 data points. If this condition is not met, data from the previous three minute intervals of summation and collection is added to the data for the current interval. This process is continued until at least 8 ranges accummulated 8 data points or until data up to 15 minutes old had been collected. In other words, the voltage value at 2 is an estimate based on 15 minutes worth of data where there are less than 8 ranges filled.

Lastly, if the voltage value at 2 provided by the above method is between 1.34 and 1.94 volts, it is employed to update a digital filter to obtain a filtered value for 2, i.e., any values for 2 lying outside of this range are not used to update the filter. The filtered value is used as the feedback value by the estimation algorithm.

Referring again to the FIG. 1, estimator 26 is shown schematically and has as a second input the electrical current of cell 10, as depicted diagrammatically by line 30. Another input to the estimator is the feed interval 12 of the cell. The inputs are used by the time update equations.

A process noise calculation is made at 38 to provide an estimate of process noise 40 for estimator 26. This noise estimate is used to modify a measurement noise variance tuning parameter. The tuning parameters and the model parameters are provided as inputs to the estimator by a process engineer and are shown collectively by line 42 in FIG. 1.

As explained earlier, the estimator contains a dynamic model of the cell process in conjunction with a knowledge of the inputs to the process in order to estimate how the process varies over time. For the problem of estimating alumina concentration, the model is a simple integrator, i.e., alumina concentration at the end of a time interval is equal to the alumina concentration at the beginning thereof plus the amount of alumina fed to the cell (in units of percent) minus the amount of alumina consumed in the production of aluminum (in units of percent) during the time interval. The amount of alumina consumed during the interval is equal to the average of line current in amps (via line 30), times the estimated current efficiency of the cell times the time interval in seconds over the weight of the bath in pounds times a conversion constant. This algorithm is termed a "time update" equation since it estimates alumina concentration of the bath over periods or intervals of time. It is also an open loop model, as it contains no feedback information for comparison purposes. The parameters of the model then are current efficiency, the volume (shot size) of alumina fed during a feed interval, and the weight of the bath.

The output 28 of algorithm 24, described earlier, provides 26 with a process feedback variable of cell 10 for modifying the time update estimate provided by the mass balance model of the estimator. The process feedback variable must be related to alumina concentration, but the relationship may be nonfunctional and nonlinear, as seen in FIG. 3.

Estimator 26 takes the output 28 of 24 and applies it in the measurement algorithm of the estimator in a manner that modifies the most recent prediction of alumina concentration from the time update, mass balance model. Since the process feedback variable contains information about the present electrolytic condition of the bath, the estimator uses it and the relationship between it and alumina to obtain a feedback estimate of alumina, and compares this value to the latest estimate of alumina concentration provided by the model; any difference that occurs between the two is multiplied by the gain of 26 and added to the time update prediction. This provides the best possible estimate of alumina concentration.

Under normal operating conditions of the estimator, the time and measurement update equations can be run by a digital computer (containing the time and measurement update algorithms) at the same frequency. On the other hand, if the process feedback variable is calculated on a slower basis than the mass balance calculation, the time update equation can be run more frequently.

The gain of 26 is also employed to shift its emphasis between the process ("state") model and the feedback measurement. The gain is obtained from estimates of the "variance" of state and measurement noise.

As explained earlier, the estimate of alumina concentration has error or "noise". Similarly, the feedback variable calculated at 24 has a noise value that represents a certain uncertainty as to whether or not one obtains an accurate measurement. The amount or intensity of the noise is called "noise variance". The estimator accounts for noise such that, in the present invention, both dissolved alumina (state) noise and measurement noise variances can be employed as tuning parameters to determine the steady state gain of the estimator. A third algorithm in the estimator updates the gain based on the two variances. The ratio of the two determines steady state gain. In this manner, if the feedback measurement is particularly noisy, it is given less or zero weight so that the time update algorithm is used to provide the best available estimate of alumina concentration. The reverse of this occurs if the feedback measurement is quiet.

Output 32 of 26, which is now the best possible estimate of alumina concentration, is directed to a summing junction 34. At junction 34, the output of 26 is combined with the target reference of 22. The target is a reference value provided by a workman observing the processes of the cell; he inputs this reference to the computer as a setpoint for control of the cell.

Junction 34 now provides an input 36 to controller 16 which is the amount of error between the target value of alumina and the estimate of alumina; in response thereto, the controller chooses a feed rate that will increase or decrease feed interval 12, depending upon the need of the cell as determined by the controller. This is effected at the summing junction of 20, junctions 20 and 34 being part of the above-mentioned digital computer.

While the invention has been described in terms of a preferred embodiment, the claims appended hereto are intended to encompass all embodiments which fall within the spirit of the invention.

What is claimed is:

1. A method of estimating and controlling the concentration of alumina in the bath of a Hall cell, the method including the use of an enhanced Kalman filter-type algorithm that employs two sets of equations, namely, a time update algorithm that contains a dynamic model of the alumina mass balance in the Hall cell and provides estimates of alumina concentration, and a measurement update algorithm that uses a feedback variable from the Hall cell process to modify the alumina estimate provided by the time update algorithm, and one or more tuning parameters, the method comprising using the time update algorithm to estimate the concentration of alumina in the bath at the end of intervals of time by adding to the previous value of said estimate the amount of alumina fed to the cell minus the amount of alumina consumed in the production of aluminum during the interval of time, extrapolating the slope of a voltage-ampere curve of the cell to a voltage value at zero current, feeding back the voltage value at zero current, as the feedback variable, to the measurement update algorithm during measurement update periods, using the same to modify the alumina estimate provided by the time update algorithm to thereby provide the best available estimate of alumina concentration, and employing this estimate to control the amount of alumina fed to the cell.

2. The method of claim 1 in which a relationship exists between the feedback variable and alumina concentration that is nonlinear and nonfunctional and, providing an algorithm to make the decision as to which part of the relationship to employ in utilizing the relationship to obtain a feedback value.

3. The method of claim 1 in which the time and measurement update equations of the enhanced Kalman filter are updated at certain intervals, the Kalman filter including a state noise variance tuning parameter algorithm such that the tuning parameter is modified by the number of updates of the time update equation occurring between the updates of the measurement equation when the two updates occur at different frequencies.

4. The method of claim 1 wherein the enhanced Kalman filter algorithm uses a mass balance model in which current efficiency is a parameter, and updating said parameter by a feed history of the cell.

5. The method of claim 1 wherein the enhanced Kalman filter algorithm uses a mass balance model in which the volume of alumina fed to the cell during a feed interval is a parameter of the model and, updating said parameter by a feed history of the cell.

6. The method of claim 1 in which the enhanced Kalman filter algorithm includes a measurement noise variance tuning parameter, while the feedback variable has a process noise variance and, using the process noise variance to modify said tuning parameter in a manner that increases measurement noise variance for high values of process noise and decreases measurement noise variance for low values of process noise.

* * * * *